United States Patent [19]

Liegel et al.

[11] 3,985,248

[45] Oct. 12, 1976

[54] TELESCOPIC BOOM ASSEMBLY

[75] Inventors: Reinald D. Liegel, Port Washington; Richard J. Hummel, Cedarburg, both of Wis.

[73] Assignee: Badger Dynamics, Inc., Port Washington, Wis.

[22] Filed: Sept. 25, 1974

[21] Appl. No.: 509,138

[52] U.S. Cl. ..... 214/141; 212/55

[51] Int. Cl.[2] ..... E02F 3/38

[58] Field of Search..... 214/141, 138 R; 212/55; 254/4 R, 4 B, 4 C; 52/118, 121

[56] References Cited

UNITED STATES PATENTS

| | | | |
|---|---|---|---|
| 3,093,248 | 6/1963 | Winter | 212/55 |
| 3,140,000 | 7/1964 | Pilch | 214/138 R |
| 3,298,548 | 1/1967 | Long et al. | 214/141 |
| 3,305,220 | 2/1967 | Nevulis | 212/55 |
| 3,478,894 | 11/1969 | Stauffer | 214/141 |
| 3,624,785 | 11/1971 | Wilson | 214/141 |
| 3,651,951 | 3/1972 | Murakami | 212/55 |
| 3,836,025 | 9/1974 | Olson et al. | 214/141 |

*Primary Examiner*—L. J. Paperner
*Assistant Examiner*—Ross Weaver
*Attorney, Agent, or Firm*—Michael, Best & Friedrich

[57] ABSTRACT

Disclosed herein is a forklift truck including a wheel supported frame, a boom assembly including an elongated outer boom pivotally connected to the frame and being of rectangular box construction including a hollow interior, an elongated inner boom telescopically located in and movable relative to the outer boom and being of downwardly open channel construction defining a downwardly open cavity, a work element carried at one end of the inner boom, hydraulic means for tilting the outer boom relative to the frame, and hydraulic means for telescopically moving the inner boom relative to the outer boom.

9 Claims, 6 Drawing Figures

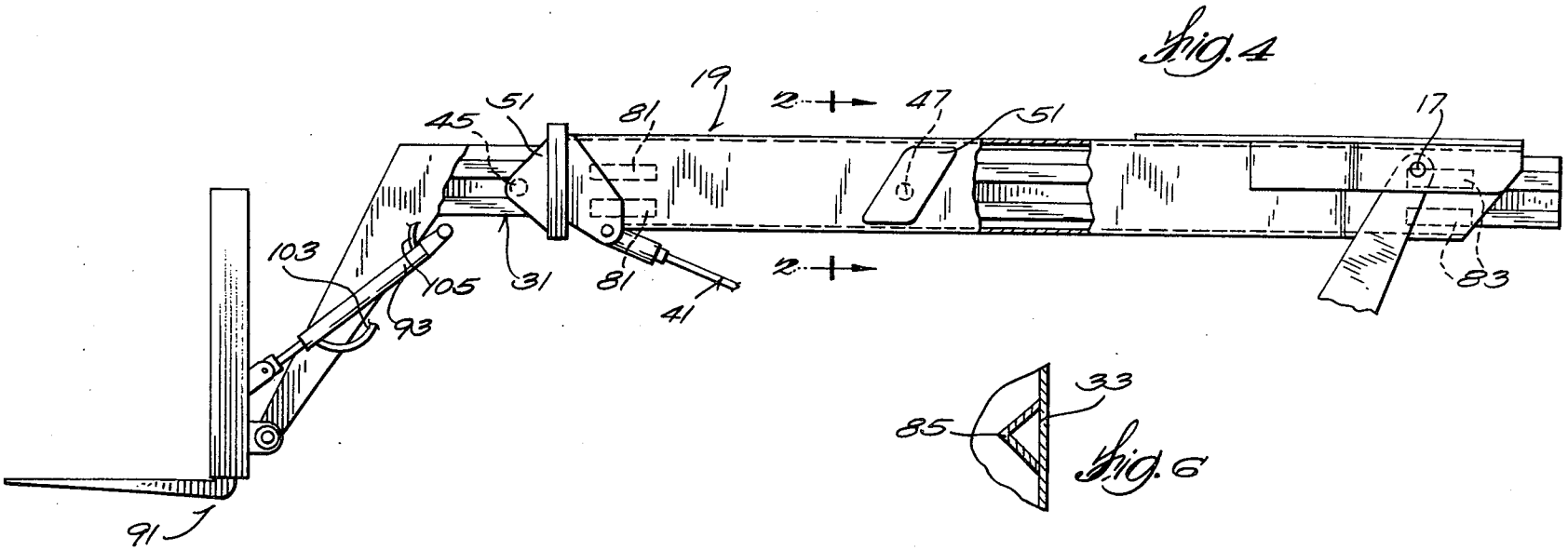
Fig. 4
Fig. 6
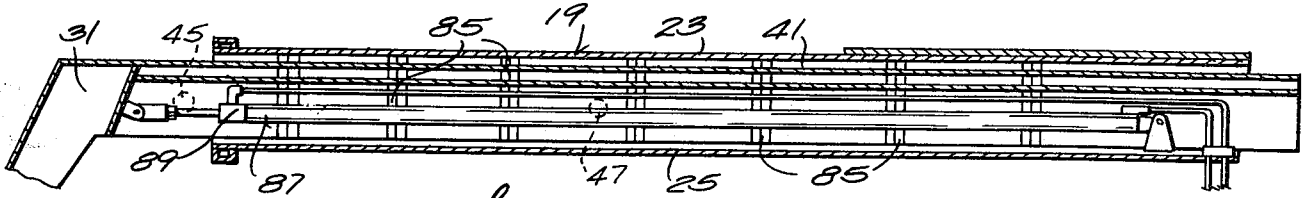
Fig. 5

TELESCOPIC BOOM ASSEMBLY

BACKGROUND OF THE INVENTION

The invention relates generally to telescopic boom assemblies for forklift trucks and other similar vehicles.

One prior forklift truck including a telescopic boom assembly is disclosed in the Mindrum U.S. Pat. No. 2,990,072 issued June 27, 1961.

Another prior forklift truck with a telescopic boom assembly is disclosed in the Soyko U.S Pat. No. 3,170,580 issued Feb. 23, 1965.

SUMMARY OF THE INVENTION

The invention provides a vehicle comprising a ground supported frame, a boom assembly including an elongated outer boom pivotally connected to the frame and being of rectangular box construction including a hollow interior, an elongated inner boom telescopically located in and movable relative to the outer boom and being of vertically open channel construction defining a vertically open cavity, a work element carried at one end of the inner boom, hydraulic means for tilting the outer boom relative to the frame, and hydraulic means for telescopically moving the inner boom relative to the outer boom.

In accordance with a preferred embodiment of the invention, the channel construction of the inner boom is downwardly open and the hydraulic means for telescopically displacing the booms relative to each other extends in the hollow interior of the outer boom and within the downwardly open cavity of the inner boom.

Also in accordance with a preferred embodiment of the invention, each of the inner and outer boom includes a pair of laterally spaced vertically extending sidewalls and there is additionally provided means on the sidewalls for guiding telescopic movement of the inner and outer booms and including means extending inwardly from each of the outer boom sidewalls and elongated means extending on the inner boom sidewalls and receiving the means extending inwardly from the outer boom sidewalls. More specifically, the means extending inwardly from the outer boom sidewalls respectively comprises a pair of longitudinally spaced rollers and the elongated means extending on the inner boom sidewalls respectively comprises an outwardly open channel having upper and lower plates in engagement with one of the pairs of rollers. Each of the channels is preferably formed by upper and lower vertically spaced channel-shaped members, with the upper channel-shaped member including a lower horizontally extending leg to which the upper wear plate is secured, and with the lower channel-shaped member including an upper horizontal leg to which the lower wear plate is secured.

Still further in accordance with a preferred embodiment of the invention, there is additionally provided respective reenforcing plates on the outer surface of the outer boom sidewalls in the area of the rollers and the inner boom is provided with a plurality of vertically extending angle-shaped reenforcing members secured to the inside surface of the inner boom sidewalls.

Still further in accordance with a preferred embodiment of the invention, the work element is pivotally connected to the inner boom and there is additionally provided a double-acting hydraulic ram connected between the work element and the inner boom, together with a hydraulic fluid conduit system connected to the hydraulic ram and mounted in the inner boom cavity. The system includes two flexible conduit portions connected to the opposite ends of the hydraulic ram and means for retaining the flexible conduit portions within the inner boom cavity notwithstanding telescopic movement of the inner boom relative to the outer boom. Preferably, the means for retaining the flexible conduit portions within the inner boom cavity comprises a support rod extending longitudinally within the inner boom cavity and a trolley movable on the support rod and including thereon two pulleys, one of the flexible conduit portions being anchored to the forward end of the inner and outer booms and being trained around one of the pulleys and the other of the flexible conduit portions being anchored to the rearward ends of the inner and outer booms and being trained around the other of the pulleys.

One of the principal features of the invention is the provision of a telescopic boom assembly including a box-like outer boom and a channel-shaped inner boom providing a vertically open cavity which is preferably downwardly open.

Another of the principal features of the invention is the provision of a telescopic boom assembly including a hydraulic ram operable to extend the boom assembly, which ram is housed, in part, within a downwardly open channel-shaped inner boom.

Another of the principal features of the invention is the provision of a telescopic boom assembly which pivotally supports, at the outer end thereof, a work element, together with a double-acting hydraulic ram operably connected between the boom and the work element, and a hydraulic conduit suspension system housed in a downwardly open channel-shaped boom cavity and including a trolley movably supported by the inner boom within the cavity and including thereon a pair of rotatably mounted pulleys.

Another of the principal features of the invention is the provisions of a telescopic boom assembly of inner and outer booms, each including an adjacent sidewall, with one of the adjacent sidewalls including thereon a longitudinally spaced pair of inwardly extending rollers and with the other of the sidewalls including an elongated channel structure receiving the rollers.

Another of the principal features of the invention is the provision of a telescopic boom assembly which is of superior strength, which has a box-like appearance, which permits access through the bottom of the inner boom to various operating components mounted therein, which is economical to manufacture, and which will provide reliable service over a long and useful life.

Other features and advantages of the invention will become known by reference of the following drawings, general description and claims.

THE DRAWINGS

FIG. 4 is an enlarged side elevational view, partially broken away and in section, of the boom assembly shown in FIG. 1.

FIG. 5 is a sectional view similar to FIG. 4.

FIG. 6 is a sectional view taken along line 6 — 6 of FIG. 2.

Figure 1:
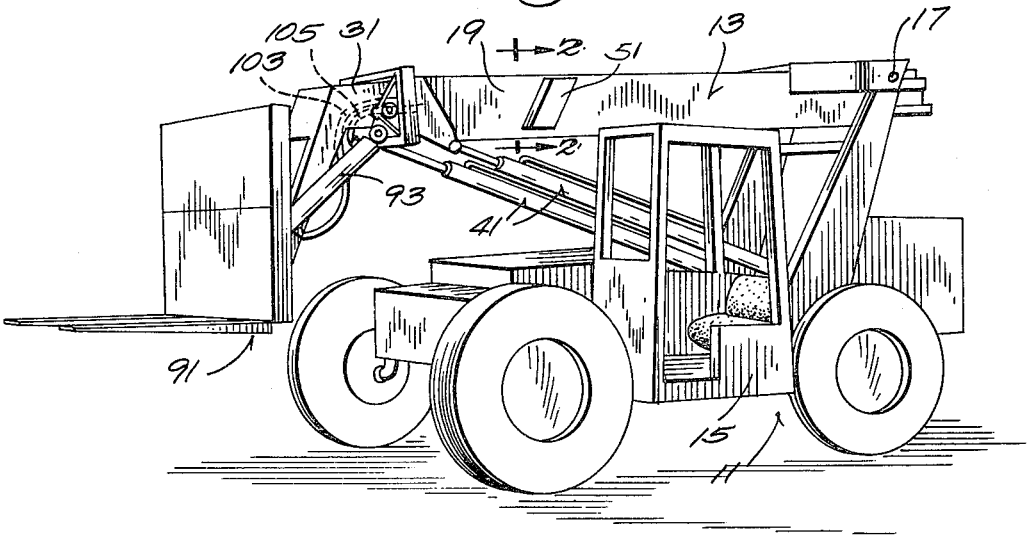
FIG. 1 is a perspective view of a fork lift vehicle including a telescopic boom assembly incorporating various of the features of the invention.
Figure 2:
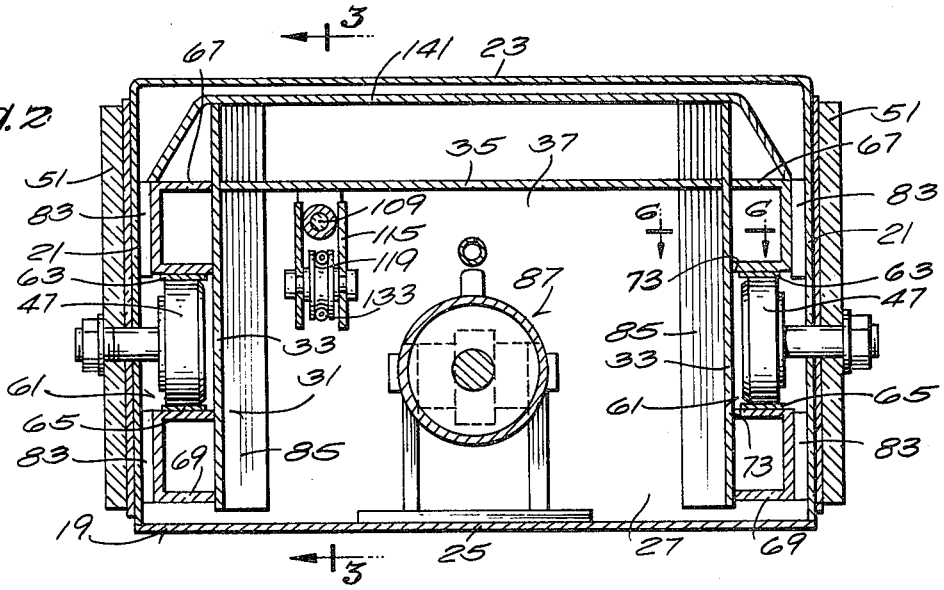
FIG. 2 is an enlarged sectional view taken along line 2 — 2 of FIGS. 1 and 4.
Figure 3:
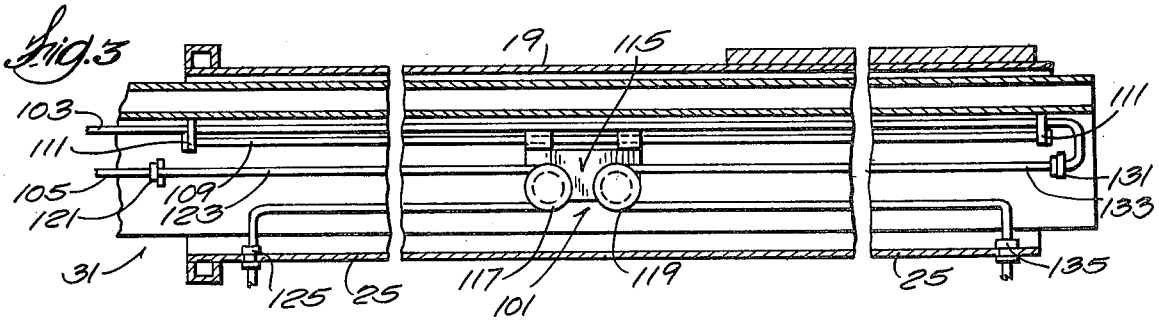
FIG. 3 is a partially schematic, fragmentary view, partially broken away and in section, taken along line 3 — 3 of FIG. 2.

Before explaining the invention in detail, is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein is for the purposes of description and should not be regarded as limiting.

GENERAL DESCRIPTION

Shown in the drawings is a fork lift truck 11 which includes a telescopic boom assembly embodying various of the features of the invention. More particularly, the fork lift truck 11 includes a wheeled frame 15 to which the boom assembly 13 is pivoted about a horizontal axis 17. The boom assembly 13 includes an outer member or boom 19 which is preferably constructed of sheet steel and which is generally of rectangular box-like construction including laterally spaced sidewalls 21 and top and bottom walls 23 and 25, respectively, connecting the sidewalls 21 to define a hollow interior 27.

The boom assembly 13 also includes an inner member or boom 31 which is telescopically movable in the outer boom 19 and which is also preferably constructed of sheet steel and which is in the form of a vertically open channel including laterally spaced sidewalls 33 and a connecting horizontal wall 35. In the preferred construction, the horizontal wall 35 comprises a top wall and the channel shape of the inner boom 31 defines a downwardly open cavity 37.

Thus the walls of the inner and outer boom 19 and 31, respectively, extend generally continuously and are generally without interruption as compared to prior booms of lattice and other types of construction.

Means are provided for tilting the boom assembly 13 relative to the frame 15 to raise and lower the boom assembly 13. Various arrangements can be employed and, in the illustrated construction, such means comprises one or more double acting hydraulic rams 41 pivotally connected at their upper or outer ends to the outer or forward end of the outer boom 19 and pivotally connected at their lower ends to the frame 15. Any suitable means can be provided for supplying hydraulic fluid to the ends of the rams 41.

In particular accordance with the invention, means are provided for guiding telescopic movement of the inner boom 31 out of and into the forward end of the outer boom 19. In the preferred construction, such means comprises means spaced lengthwise of the outer boom 19 and extending inwardly from the sidewalls 21, together with means extending outwardly from the sidewalls 33 of the inner boom 31 for engagement with the means extending inwardly from the sidewalls 21 of the outer boom 19. In the illustrated construction, the means extending inwardly from the outer boom sidewalls 21 include, on each sidewall, a longitudinally spaced pair of rollers 45 and 47. As shown, the roller 45 is mounted adjacent to the forward end of the outer boom 19 and the roller 47 is mounted forwardly of the mid-part of the outer boom 19. Preferably, the outer boom sidewalls 21 are reinforced on the outside surface thereof by plates 51 located in the area in which the rollers 45 and 47 are mounted.

More specifically with respect to the guide means extending laterally outwardly from the inner boom sidewalls 33, such means comprises, on each sidewall, an elongated outwardly open channel 61 having upper and lower wear plates 63 and 65 engageable with the rollers 45 and 47 which project into the channel 61. In the preferred construction, the laterally outwardly open channels 61 are formed by upper and lower channel-shaped members 67 and 69 which are welded or otherwise secured to the inner boom sidewalls 33 and which respectively include a lower surface 71 and an upper surface 73 to which the wear plates 63 and 65 are fixed.

Use of the disclosed construction provides economy in manufacturing, while at the same time, permits maintenance of close tolerances between the wear plates, thus avoiding sloppiness in construction and thereby providing a safer and more reliable boom assembly capable of handling heavier loads.

In addition, in order to provide lateral guidance, the inside surfaces of the outer boom sidewalls 21 adjacent the forward end thereof, are provided with respective bearing plates 81 which are engageable with the outside surfaces of the inner boom sidewalls 33. In addition, the inner boom 31 includes, adjacent the rearward end thereof, and on each of the side walls 33, a bearing plate 83 which engages the adjacent inside surface of the outer boom sidewalls 21. Thus, the inner boom 31 is stabilized against lateral movement during telescopic movement relative to the outer boom 19.

Preferably the inside of the sidewalls 33 of the inner boom 31 are provided with a plurality of vertically extending and spaced reenforcing members 85 which can be of angle iron and which have their outer edges welded to the side walls as shown in the drawings.

Means are provided for telescopically moving the inner boom 19 relative to the outer boom 21. More particularly, such means comprises a hydraulic ram 87 which has one end connected adjacent to the rearward end of the top surface of the bottom wall 25 of the outer boom 19, which extends in the downwardly open cavity 37 of the inner boom 31, and which is connected to the forward end thereof. The cylinder of the hydraulic ram 87 is located in the box-like structure of the outer boom, extends for substantially the full length thereof, and includes adjacent the outer end of the outer boom 19, a removable end cap 89. Location of the hydraulic ram 87 below the top or horizontal wall 35 of the inner boom 31 and within the downwardly open cavity 37 affords protection from falling objects while, at the same time, affords access from below for inspection and repair as may be desired.

At the outer end of the inner boom 31 there is movably mounted a tool or work element in the form of a fork structure 91 which is pivotally shiftable relative to the inner boom 31 by one or more double acting hydraulic rams 93 which, at one end, are connected to the inner boom 31 and which, at the other end, are connected to the fork structure 91.

Mounted within the hollow interior 27 of the outer boom 19 and within the downwardly open cavity 37 of the inner boom 31 is a hydraulic fluid supply or conduit system 101 for the double acting hydraulic ram or rams 93. More specifically, two hydraulic conduits 103 and 105 are located in the boom assembly 13 and respectively communicate with the opposite ends of the hydraulic ram or rams 93. In addition, means are provided for mounting the hydraulic conduits 103 and 105 to the inner boom 31 so as to maintain fluid communication to the hydraulic ram or rams 93 while retaining the conduits 103 and 105 within the inner boom 31, notwithstanding relative movement between the inner and outer booms 19 and 31.

In this last regard, there is provided in the downwardly open cavity 37 of the inner boom 31, an elongated support rod 109 which is supported by spaced hangers 111 and which carries for movement there along a trolley 115 having rotatably mounted thereon rearward and forward pulleys 117 and 119, respectively. The conduit 105 extends from the hydraulic ram 93 to an anchor 121 adjacent the outer end of the inner boom 31 and includes a flexible portion 123 which extends rearwardly and around the pulley 117 and then forwardly to a nipple 125 which communicates through the bottom wall 25 of the outer boom 19 adjacent the forward end thereof with a suitable source of fluid pressure.

The other conduit 103 extends from the other end of the hydraulic ram 93 and fixedly along the inner boom 31 from the forward end to an anchor 131 located adjacent the rearward end of the inner boom 31. Thereafter, the conduit includes a flexible portion 133 which extends forwardly and around the other pulley 119 on the trolley 115 and then rearwardly to a nipple 135 which communicates through the bottom wall 25 of the outer boom 19 adjacent to the rearward end thereof with a suitable source of fluid pressure. Thus, when the inner boom 31 moves telescopically inwardly or outwardly, the trolley 115 moves along the support rod 109 in the inner boom 31, playing out one of the flexible conduit portions 123 and 133 in one direction while taking up the other flexible conduit portion in the other direction. Thus there is provided a conduit system which is accessible within the downwardly open cavity 37 of the inner boom 31 and which retains the flexible conduit portions 123 and 133 within the inner boom cavity 37 notwithstanding relative telescopic movement of the inner and outer booms. Accordingly, the top of the inner boom 31 offers protection from falling objects without adversely affecting access to the system 101 from below for inspection and repair as may be desired.

For purposes of appearance, the upper channel members 67 of the inner boom 31 are connected with a cover or hood member 141 which spans between the sidewalls 33 in upwardly spaced relation from the horizontal wall 35, thus providing additional strength and thus also providing a more or less continuous top and side surface between the channels 61 into which the rollers 45 and 47 are received.

Actuation of the hydraulic ram 87 serves to telescopically move the inner boom 31 relative to the outer boom 19. Such boom movement is guided by the rollers 45 and 47 which are received in the laterally spaced channels 61 and by engagement of the bearing plates 81 and 83 against the adjacent sidewalls. At the same time, the flexible conduit portions 123 and 133 connected to the hydraulic ram or rams 93 controlling the position of the fork structure 91 are carried by the trolley 115 so as to retain the conduit portions 123 and 133 within the downwardly open cavity of the inner boom 31. It is to be particularly noted that the disclosed boom assembly 13 is of particularly rigid construction, while at the same time, affords protection for the hydraulic ram 87 and for the hydraulic conduit supply system 101, while also afforing easy access thereto through the open bottom of the inner boom cavity 37.

Various of the features of the invention are set forth in the following claims:

The embodiments of the invention in which an exclusive property or privilege is claimed are defined as follows:

1. A vehicle comprising a ground supported frame, a boom assembly including an elongated generally horizontally extending outer boom pivotally connected to said frame and being of rectangular box construction including a hollow interior, an elongated inner boom telescopically located in said hollow interior of said outer boom and movable relative to said outer boom and being of downwardly open channel construction defining a downwardly open cavity extending for substantially the length of said inner boom to permit access to said cavity, a work element carried at one end of said inner boom, first hydraulic means connected between said outer boom and said frame for tilting said outer boom relative to said frame, and second hydraulic means connected between said inner boom and said outer boom and extending in said cavity for telescopically displacing said inner boom relative to said outer boom, whereby the downwardly open cavity provides access from below to said second hydraulic means while also providing protection from above to said second hydraulic means.

2. A vehicle in accordance with claim 1 wherein each of said inner and outer booms includes a pair of laterally spaced vertically extending sidewalls and further including means on said sidewalls for guiding telescopic movement of said inner and outer booms and including means extending inwardly from each of said outer boom sidewalls and elongated vertically spaced means extending on said inner boom sidewalls and receiving therebetween said means extending inwardly from said outer boom sidewalls.

3. A vehicle in accordance with claim 2 wherein said means extending inwardly from said outer boom sidewalls respectively comprises a pair of longitudinally spaced rollers and said elongated means extending on said inner boom sidewalls respectively comprises an outwardly open channel having upper and lower wear plates in engagement with one of said pairs of said rollers.

4. A vehicle in accordance with claim 3 wherein each of said channels is formed by upper and lower vertically spaced channel-shaped members, said upper channel-shaped member including a lower horizontally extending leg and said lower channel-shaped member including an upper horizontal leg, said wear plates being secured to said upper and lower legs.

5. A vehicle in accordance with claim 4 including respective reenforcing plates on the outer surface of said outer boom sidewalls in the areas of said rollers.

6. A vehicle in accordance with claim 2 and further including a plurality of vertically extending angle-shaped reenforcing member secured to the inside surface of said inner boom sidewalls.

7. A vehicle in accordance with claim 2 wherein said means on said sidewalls for guiding telescopic movement of said inner and outer booms further includes bearing plates respectively mounted at the rearward end of the outside surfaces of said inner boom sidewalls and in engagement with the inside surfaces of said outer boom sidewalls and bearing plates respectively mounted on the forward end on the inside surface of said outer boom sidewalls in engagement with the outside surface of said inner boom sidewalls.

8. A vehicle in accordance with claim 1 wherein said work element is pivotally connected to said inner boom and further including a double-acting hydraulic ram connected between said work element and said inner boom and a hydraulic fluid conduit system connected to said hydraulic ram and mounted in said inner boom cavity, said system including two flexible conduit portions connected to the opposite ends of said hydraulic ram, and means for retaining said flexible conduit portions within said inner boom cavity notwithstanding telescopic movement of said inner boom relative to said outer boom.

9. A vehicle comprising a ground supported frame, a boom assembly including an elongated outer boom pivotally connected to said frame and being of rectangular box construction including a hollow interior, and elongated inner boom telescopically located in and movable relative to said outer boom and being of vertically open channel construction defining a vertically open cavity, a work element pivotally connected to one end of said inner boom, hydraulic means for tilting said outer boom relative to said frame, hydraulic means for telescopically displacing said inner boom relative to said outer boom, a doubleacting hydraulic ram connected between said work element and said inner boom, and a hydraulic fluid conduit system connected to said hydraulic ram and mounted in said inner boom cavity, said system including two flexible conduit portions connected to the opposite ends of said hydraulic ram, and means for retaining said flexible conduit portions within said inner boom cavity notwithstanding telescopic movement of said inner boom relative to said outer boom, said means for retaining said flexible conduit portions within said inner boom cavity comprising a support rod extending longitudinally within said inner boom cavity and a trolley movable on said support rod and including thereon two pulleys, one of said flexible conduit portions being anchored to the forward ends of said inner and outer booms and being trained around one of said pulleys and the other of said flexible conduit portions being anchored to the rearward ends of said inner and outer boom and being trained around the other of said pulleys.

* * * * *